US006131404A

United States Patent [19]

Hase et al.

[11] Patent Number: 6,131,404

[45] Date of Patent: Oct. 17, 2000

[54] INSULATED CONTAINER

[75] Inventors: Gary M. Hase, Monee, Ill.; Colin Trundley, Middlesex, United Kingdom; Laura Lozza, Oslo, Norway; Paul Shottom, Stoke-on-Trent, United Kingdom; Åse Spangelo, Stathelle, Norway

[73] Assignees: H & R Industries, Inc., Beecher, Ill.; Norsk Hydro ASA, Norway

[21] Appl. No.: 09/335,621

[22] Filed: Jun. 18, 1999

[30] Foreign Application Priority Data

Jun. 26, 1998 [NO] Norway ..... 982971

[51] Int. Cl.[7] ..... F25D 3/12

[52] U.S. Cl. ..... 62/384; 62/457.2; 165/96; 165/919

[58] Field of Search ..... 62/384, 385, 388, 62/457.1, 457.2, 457.7; 165/96, 918, 919

[56] References Cited

U.S. PATENT DOCUMENTS

| | | | |
|---|---|---|---|
| 1,997,936 | 4/1935 | Kiesel . | |
| 2,024,648 | 12/1935 | Kissling et al. | 62/388 |
| 2,065,986 | 12/1936 | Rice, Jr. . | |
| 2,143,239 | 1/1939 | Foltz | 62/384 |
| 2,170,332 | 8/1939 | Justheim . | |
| 2,508,385 | 5/1950 | Hall . | |
| 3,800,554 | 4/1974 | Knapp et al. | 62/384 |
| 3,866,435 | 2/1975 | Frank et al. | 62/382 |
| 3,971,231 | 7/1976 | Derry | 62/388 |
| 4,898,294 | 2/1990 | Jennings | 62/384 |
| 4,907,423 | 3/1990 | Hase | 62/384 |
| 5,953,928 | 9/1999 | Saia, III et al. | 62/384 |

FOREIGN PATENT DOCUMENTS

| | | |
|---|---|---|
| 0591047B1 | 4/1994 | European Pat. Off. . |
| 0337860B1 | 5/1996 | European Pat. Off. . |
| 0631096B1 | 7/1997 | European Pat. Off. . |
| 9525253 | 9/1995 | WIPO . |
| WO9525253 | 9/1995 | WIPO . |

*Primary Examiner*—William E. Tapolcai
*Attorney, Agent, or Firm*—Trexler, Bushnell, Giangiorgi & Blackstone, Ltd.

[57] ABSTRACT

A method and a container for storing or transporting goods, in particular food products in a frozen and/or chilled state, include a conditioned room where the goods are placed. The room is conditioned by means of a refrigerating medium, for instance solid carbon dioxide, arranged above the room, the refrigerating medium and the room being divided by an insulated panel. A variety of insulated panels can be provided between the refrigerating medium and the room so as to maintain a required amount of cold transfer between the refrigerant and the room. The amount of refrigerating medium can be varied in accordance with specifications such as the assumed duration of the transport/storage, the required storage temperature and a predicted average of the ambient temperature.

18 Claims, 4 Drawing Sheets

INSULATED CONTAINER

BACKGROUND OF THE INVENTION

This invention is generally directed to a method for refrigerating insulated containers by the use of a refrigerating medium and to a container refrigerated in accordance with the method. In particular, the invention relates to containers for the transportation and storage of frozen and/or chilled products, where the temperature inside the container is maintained at a desired level and for a specified period of time. Further, the invention makes possible that one type of container may be used for handling both chilled and/or frozen products, with minor modifications.

EP 0 591 047 B1 discloses an insulated container equipped with a refrigerant box in the upper region of the container and a stack of products in a lower region of the container. Below the refrigerant box there is arranged an insulated panel having a horizontal extension that allows the formation of a slit between the panels and the inner walls of the container. The slit allows an even distribution of the cooling medium that passes toward the products and further downwards between the outer walls of the stack and the inner walls of the container.

EP 0 631 096 B1 discloses a system for filling a receptacle or cell with $CO_2$-snow, the receptacle being arranged in an insulated chamber. The quantity of $CO_2$ injected in the receptacle is determined according to predetermined injection periods modified according to climatic parameters. EP 0 337 860 B1 discloses an isothermal container with an interior space divided horizontally by a screen into an upper area receiving an open reservoir of a sublimating refrigerant, and a lower area receiving at lest one compartment of products to be kept cold. The screen is produced from a thermally insulating material and is slightly smaller than the internal section of the container. The reservoir is produced in the form of a drawer.

WO 95/25253 discloses a double-sided releasable partition element for an isothermal chamber, containing two adjacent compartments, i.e. a first unsealed compartment which can be filled with a solid sublimable coolant element and a second sealed compartment or housing filled with a eutectic or air. The two-compartment partition element maintains significantly different temperatures or opposite sides of the element. The element is further arranged to fit into grooves in the lateral sides of the chamber.

OBJECTS AND SUMMARY OF THE INVENTION

In accordance with the present invention, a container is provided that may serve plural requirements, namely, the storage or transport of chilled and/or frozen products for a specified period of time. The container is of a thermally insulated type and comprises one or more top mounted refrigerating cells of different capacities cooperating with one or more insulated panels of different cold transfer characteristics which allows that the desired temperature and the duration of the conditioned climate inside the container can be adapted to meet a variety of demands.

In accordance with the present invention, the same container can be used for different purposes by simple insertion of different cell/panel combinations. Cost reduction stems from considerations about level of investment, inventory/storage, etc. This may be advantageous both for the user and/or for the supplier, especially if the supplier will rent out containers for various purposes. Another advantage provided by the present invention is the flexibility with respect to today's changing requirements on temperature ranges accepted for different product categories, with new products emerging in the market, and with varying relative volumes of chilled/frozen goods. Further, the cell/panel modular system of the present invention is user-friendly by the warehouse operators. Its simplicity will help minimize incorrect use of transport conditions, which should give a reliable protection of the coldchain.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
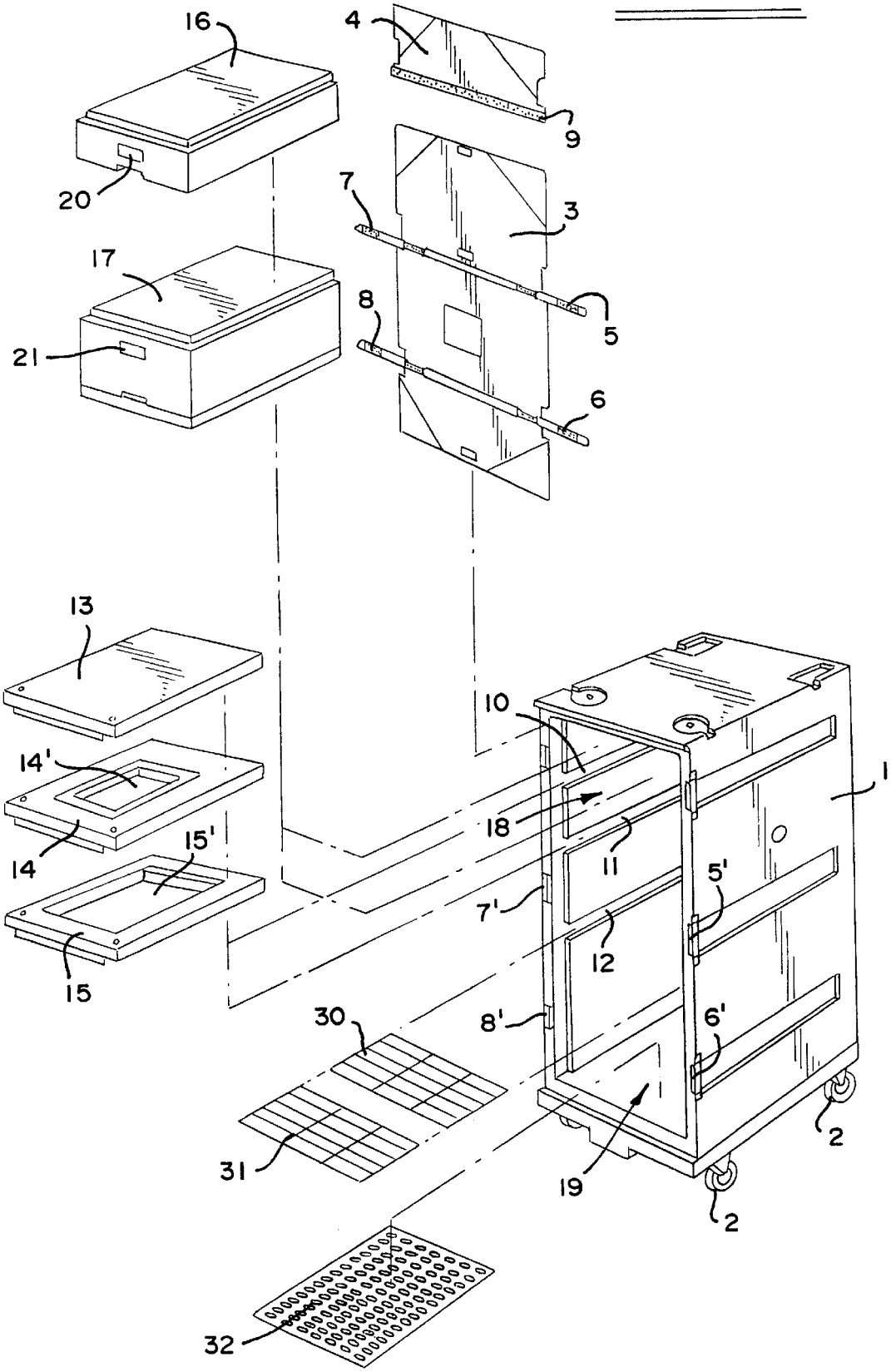
FIG. 1 is an exploded perspective view of a container which incorporates the features of the invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

As shown in FIG. 1, a container 1 is provided with wheels 2 for easy handling. The container 1 has rigid top and bottom walls, rigid sidewalls and a rigid backwall. The container 1 may preferably be of an insulated sheet type, i.e., the shell forming the inner and outer surfaces of the walls envelope a layer of insulating material such as polyurethane foam. The shell may be produced for instance out of polyethylene or fiberglass, or out of any suitable material having good insulating properties.

The front wall of the container 1 is provided by a flexible door, that may be of a two-part type with an upper door 4 and a lower door 3. The doors 4, 3 may be made out of a vinyl coated polyester and may further be sectioned in plural hinged elements. The doors 4, 3 may be provided with fasteners (not shown), for instance of the VELCRO® type, at its peripheral edges that cooperate with similar fasteners (not shown) at the front end sides of the container 1. In addition, the lower door 3 may be provided with strip fasteners 5, 6, 7, 8, preferably of the VELCRO® type, that cooperate with pins 5', 6', 7' 8' in the front end sides of the container 1. The upper door 4 and the lower door 3 may be interconnected by a fastener system 9, preferably of the VELCRO® type.

The inner side walls of the container 1 are provided with a slide system such as opposite grooves or recesses 10, 11, 12 at different vertical levels, to sustain one or more insulated panels 13, 14, 15, and one or more cells 16, 17. In the described embodiment, each insulating panel 13, 14, 15 has a transversal extension which allows for cooperation of the panel 13, 14, 15 with opposite recesses 10, 11, 12 in the side walls of the container 1. It should be understood, however, that other sliding systems known in by those skilled in the art may be applied within the scope of the invention. When inserted in the container 1, the panel divides the interior of the container 1 into an upper room 18 and a lower room 19. In the upper room 18, the refrigerant or sublimating agent is placed, while the lower room 19 provides a space for the goods to be stored or transported. The refrigerant is contained in a cell which has a size adapted to the required cooling capacity. In some specific cases, the insulating panel may be incorporated into the cell construction for the purpose of practicality. In such an embodiment, the insulating panel is in fact a part of the cell where it serves the additional purpose of being the bottom of the cell. The cell then further comprises side walls integrated upon the upper surface of the panel, and a top lid.

In FIG. 1, there is shown three insulating panels 13, 14, 15. Panel 13 is a of a closed type, i.e., panel 13 is not provided with any perforations. In use, gas falling downward from the sublimating agent within the cell, for example cell 16, is allowed in small amounts to enter the lower room 19 through small slits between the panel 13 and the recesses, for example 12, in the side walls of the container 1, between the panel 13 and the door and/or between the panel 13 and the backwall of the container 1. In this situation, there is little direct cooling of the goods by the sublimating agent. Alternatively, the gas may be vented directly to the ambient space from the room 18 through venting openings (not shown) that penetrate one or more walls of the container 1. The amount of indirect cooling, i.e., the cold transfer through the insulating panel 13, is very much dependent on the insulating characteristics of the panel 13. When the goods in the lower room 19 are to be chilled, i.e., the set temperature is about 0° C. to 5° C., the insulating panel 13 should be of the closed type as described to avoid direct contact cooling of the goods, to avoid damage of the goods. Further, when handling chilled goods, the insulating characteristics of the panel 13 should be sufficiently large to avoid too much cold transfer between the upper room 18 and the lower room 19. On the other hand, the insulating characteristics of the panel 13 should be sufficiently low to allow the temperature to be maintained at the required level together with the cold transferred by direct cooling.

The insulating panels of the type 14 and 15 are provided with openings 14' and 15', respectively. In FIG. 1, the opening 15' of panel 15 is of a larger size than the opening 14' of panel 14. In one embodiment, these panels 14, 15 are adapted to carry or sustain one cell, such as 16, containing the refrigerant, in such a manner that the closed bottom of the cell 16 abuts the upper surface of the panel 14 or 15. In the combination with an open panel of the type 14 or 15, the cell 16 then covers the opening 14' or 15' and thus the area of the openings for the passage of sublimating gas between the upper room 18 and the lower room 19 is of the same order as of that with the closed panel 13. In this situation, the amount of direct cooling should be similar to that of the situation with a closed panel 13. The effect of indirect cooling, however, becomes higher as the opening 14' or 15' in the panel 14 or 15 results in that the insulating characteristics of the panel 14, 15 becomes very low. Panel 15 which has a larger opening 15' provides a higher effect of indirect cooling than that of panel 14 which has a smaller opening 14', and is very well suited for refrigerating frozen goods, i.e., the temperature in the lower room 19 should be in the order of −18° C. to −30° C.

Alternatively, the cell, for example 16, may rest upon the panel 14 or 15 in such a manner that a little space is maintained between the bottom surface of the cell 16 and the top surface of the panel 14 or 15, to obtain a slit for the passage of sublimating gas, and thus augmenting the effect of direct cooling of the goods in the lower room 19. Such a space may be obtained by providing the bottom surface of the cell, for example 16, or the top surface of the panel 14 or 15 with protrusions or the like. Alternatively the cells 16, 17 may be self-sustained by a sliding system (not shown) co-operating with the inner side walls of the container 1 similar to that of the panels 13, 14 or 15. In this manner the cell, for example 16, and the panel, for example 14, may be sustained in such a manner that a space is maintained between them, similar to the situation as described above.

The cells 16, 17 containing the refrigerant may be of different sizes. As shown in FIG. 1, two sizes are shown. Cell 16 is designed for one-day storage/transport and cell 17 is designed for three-day storage/transport. The cell 16, 17 is preferably of a shell-type construction, insulated by a polyurethane foam. The foam is maintained within the shell, where the shell forms the inner and outer surfaces of the cell walls. The shell may be made out of fiberglass. It is to be understood, however, that other suitable materials may be applied in the cell construction.

Figure 3:
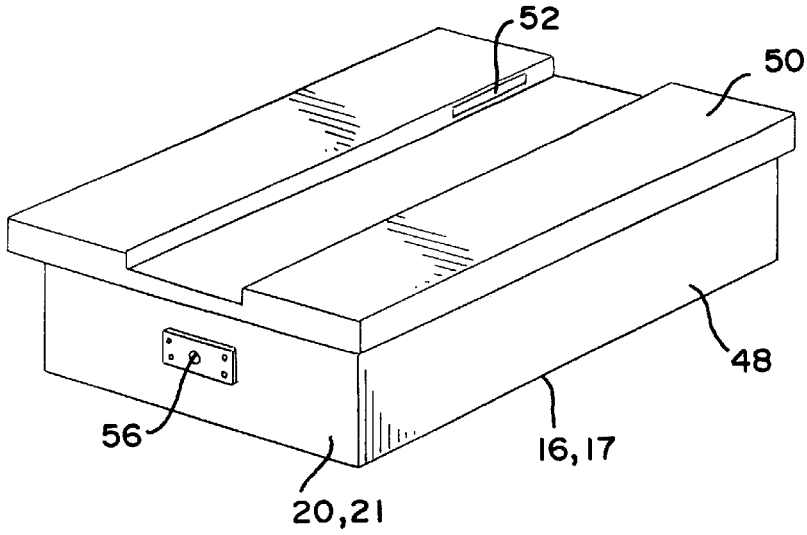
FIG. 3 is a perspective view of a cell which can be used in the container.
Figure 4:
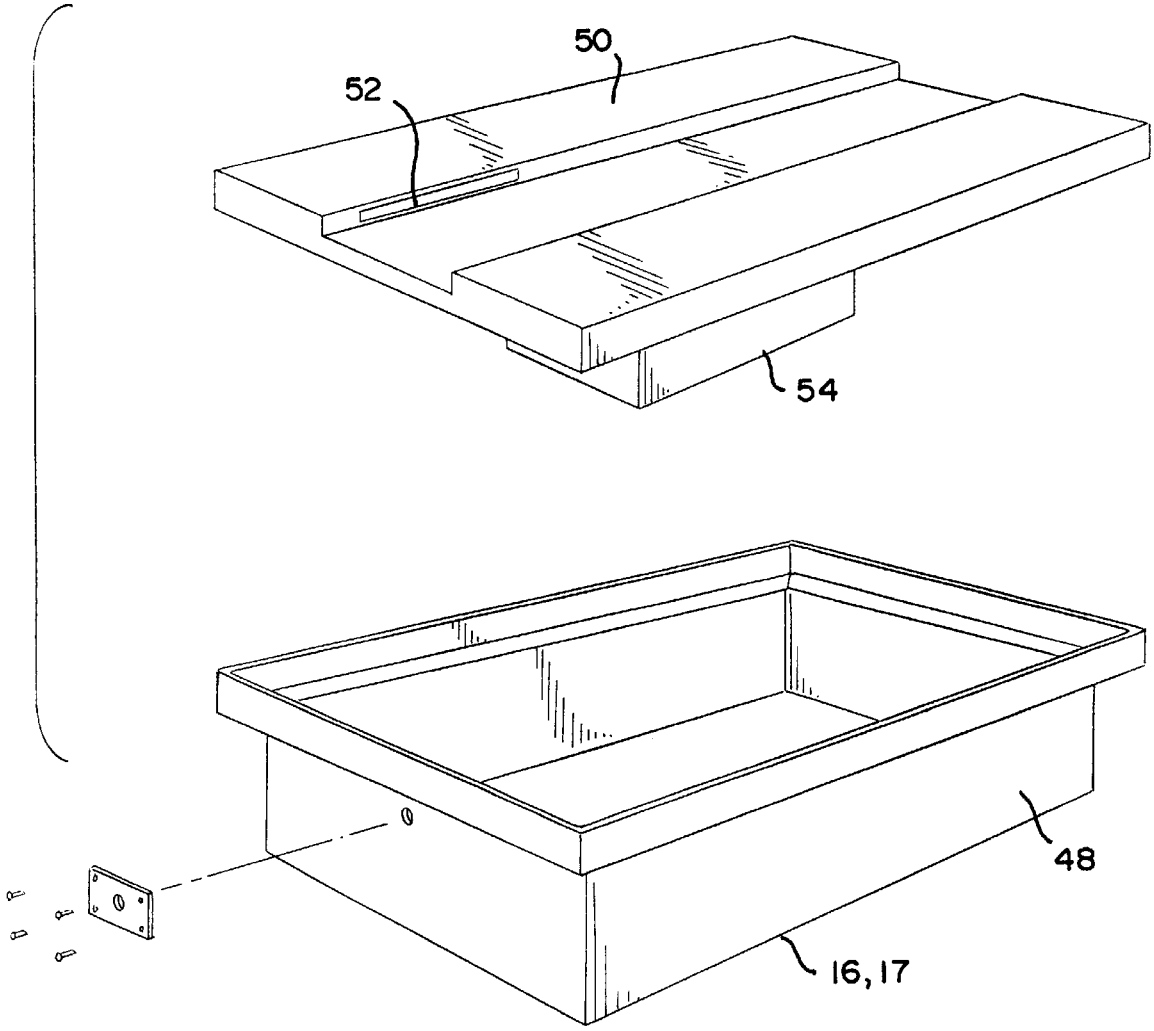
FIG. 4 is an exploded perspective view of a cell that is similar to the cell of FIG. 4 and which can be used in the container.

FIG. 3 and 4 illustrate preferred constructions of the cell 16, 17. The cell 16, 17 includes a open-ended box-like body 48 having a removable lid 50 which is made out of a non-insulated material, e.g. a mono-layer fiberglass material. The lid 50 has at least one venting slot or venting opening 52 provided therethrough for the escape of sublimating gas. An injection port 56 is provided through a side wall of the cell body 48. The cell 16, 17 is preferably adapted to be filled by an injection wand or lance through the injection port 56 to deliver liquid $CO_2$ into the cell 16, 17. In the cell 16, 17, the liquid is transferred to solid $CO_2$ under the filling operation as the pressure drops.

A bottomless, downward protruding chamber 54 is provided on the underside of the lid 50. A calculated spacing is provided between the cell floor and the chamber 54 so that $CO_2$ injected through the injection port 56 by an injection wand or lance (not shown) is contained in an enclosed area during injection. This, along with the venting slots 52, provides for a small amount of snow particles to be discharged and also increases the density of the solid $CO_2$ when filling the cell 16, 17 by as much as 20% including uniform distribution of snow allowing for a maximum charge of the cell area. When the filling operation is performed, the injection wand or lance is inserted through aligned injection ports 56 both in the cell wall 20, 21 and the chamber wall (not shown). Between the downward protruding chamber 54 walls and the inner bottom of the cell 16, 17, there is a little space which allows the solid $CO_2$ to be forced into the rest of the space in the cell 16, 17 as the cell 16, 17 becomes filled up. Thus, the restriction formed between the walls of the chamber 54 and the bottom of the cell 16, 17 generates a compression of solid $CO_2$ which is supplied succeeding the filling up of the chamber 54. By increasing the compaction and thus the density of the solid $CO_2$ (snow or dry-ice), it is possible to both utilize the cell 16, 17 volume at best, optimizing the container 1 volume available for loading products inside. By this, it may also be possible to slow down the sublimation rate of solid $CO_2$ because the surface area of the solid $CO_2$ is reduced by compaction. Following this, it is achieved a more gradual/efficient/reliable heat exchange.

Preferably, the injection port 56 in the cell 16, 17 is in the front wall 20, 21 thereof. The injection port 56 is then effectively sealed by the inner surface of the upper door 4 when the upper door 4 is in its closed position.

Alternatively, the cell 16, 17 can receive solid $CO_2$ in the shape of slices, pellets or the like by removing the top 50 and inserting same within the body 48 and thereafter replacing the top 50. In this embodiment, the chamber 54 can be eliminated.

$CO_2$ snow produced elsewhere may also be introduced into the cell 16, 17. In such an arrangement, the cell 16, 17 may have provisions to fit the interior sliding system of the container 1 similar to that explained above, but the cell 16, 17 may be constructed more like a drawer having insulated bottom and sides and further provided with a removable lid.

Figure 5:
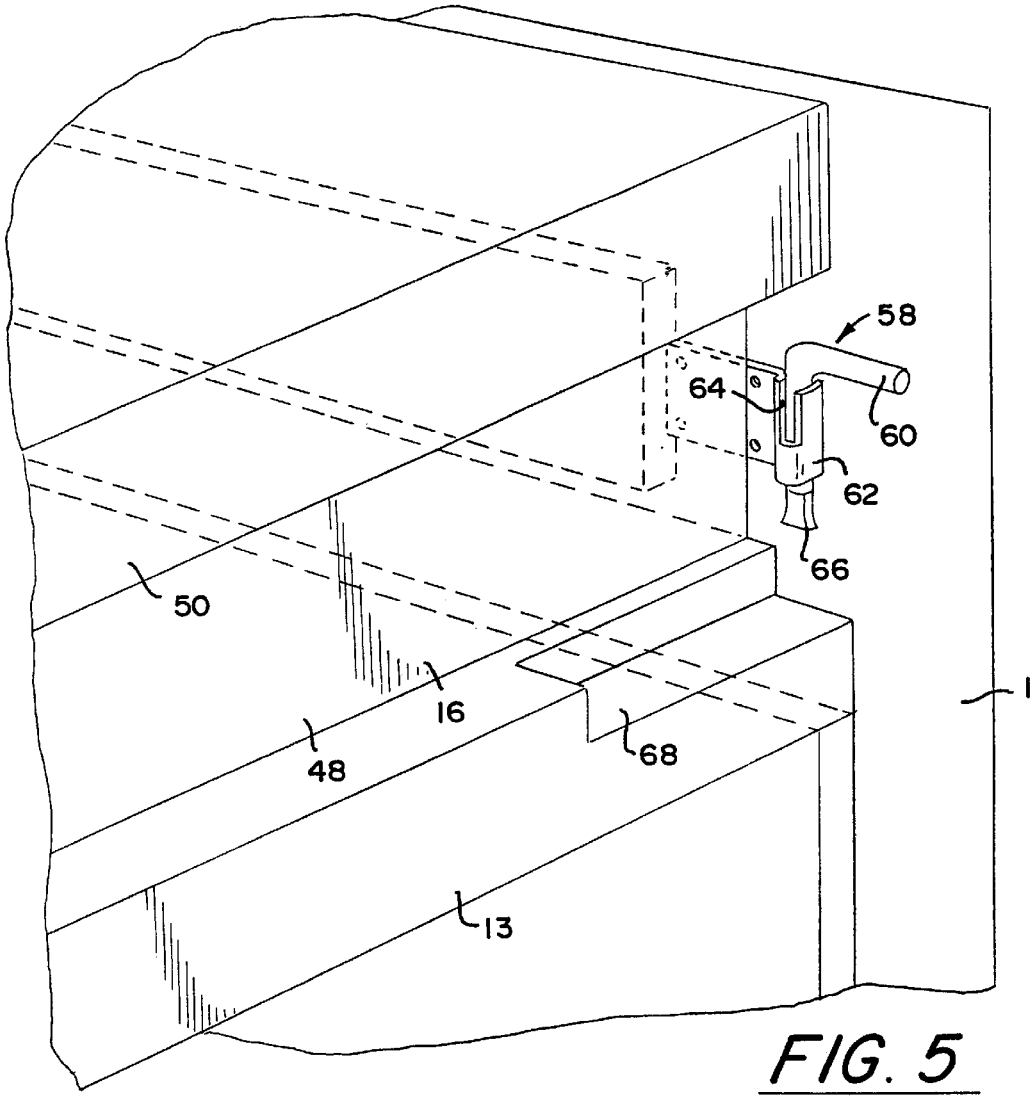
FIG. 5 is a perspective view of a latch in an open position, such latch being capable of securing a cell and an insulating panel within the container.
Figure 6:
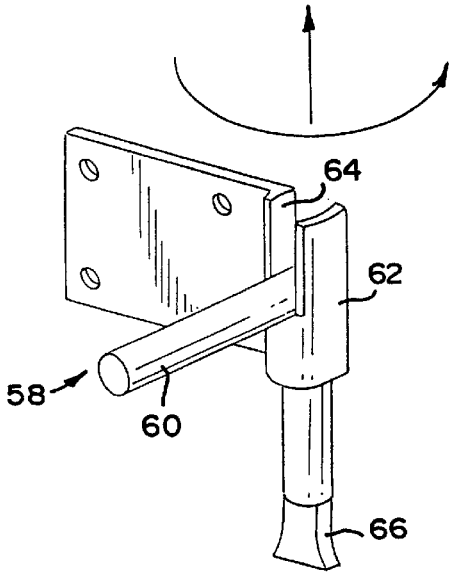
FIG. 6 is a perspective of the latch in a closed position.

As shown in FIGS. 5 and 6, the cell, for example 16, and the insulating panel, for example 13, may be prevented from sliding out of the sliding system by the provision of a latch 58 arranged at each front end sides of the container 1 in such a manner that the latches 58 will restrict outward movement of the cell 16 when the latches 58 are moved to a closed position. Each latch 58 includes an L-shaped latch arm 60 which has an upper, horizontal leg and a lower, vertical leg. The L-shaped latch arm 60 is slidably mounted in a through bore provided through a respective housing 62. The housing 62 has a U-shaped cutout 64 at a top end thereof. The bottom end 66 of the vertical leg of the latch arm 60 is upset and enlarged after it is slid through the housing 62 such that it is larger than the through bore so that the latch arm 60 cannot thereafter be disengaged from the housing 62.

Each latch arm 60 can be positioned in an open position as shown in FIG. 5 such that the vertical leg is seated on top of the housing 62 and parallel to the side wall of the container 1. When the latches 58 are in this open position, the cell 16 and the insulating panel 13 can be removed from the container 1.

Each latch 58 can be moved to a closed position as shown in FIG. 6 by rotating the latch arm 60 to align the vertical leg with the cutout 64 such that the vertical leg drops downwardly into the cutout 64 and is perpendicular to the respective side wall of the container 1. The horizontal leg of the latch arm 60 engages against the cell 16. The end 66 of the vertical leg of the latch 60 engages against the insulating panel 13. The insulating panel, for example 13, can have respective recesses 68 into which the respective ends 66 engage. Each latch 58 is easily opened by lifting the vertical leg upwardly until it clears the upper end of the housing 62 and thereafter rotating the vertical leg until it is parallel with the side wall of the container 1.

The container 1 may be further provided with compartment panels 30, 31 for dividing a stack of stored goods. The compartment panels 30, 31 are open and are preferably of a two piece wire shelf type that secures good gas circulation properties. In addition, the container 1 may be provided with a false floor 32, that provides a slit between the bottom surface of the goods and the surface of the container 1 bottom. Still further, it should be understood that the stack of goods (not shown) may be restricted from contacting the inner wall surfaces of the container by an arrangement of spacers or the like (not shown) arranged between the stack of goods and the inner walls of the container 1.

Alternatively, the compartment panels 30, 31 can be substituted by insulating panels 13, 14 or 15 dividing the lower room 19 into an upper compartment and a lower compartment. The upper compartment will then receive more cold from the upper room 18 containing the cell 16, 17 than the lower compartment. By adapting the insulating characteristics of the insulating panel 13, 14 or 15 between the upper compartment and the lower compartment in a proper manner analogous to that described above, there can be obtained a lower temperature in the upper compartment than that of the lower compartment. Accordingly, both frozen and chilled goods can be handled at the same time in the container 1.

As a further additional feature, the insulating panel dividing the lower room 19 into one upper and one lower compartment may itself comprise an internal cavity for the introduction of solid sublimable coolant, such as $CO_2$, where the loading principle may be similar to that of the cell, as described above. The insulating panel then may have different insulating characteristics towards its upper side than towards its lower side. In this situation, the insulating panel will serve as an additional source of cold towards the compartments facing its upper and lower sides.

Figure 2C:
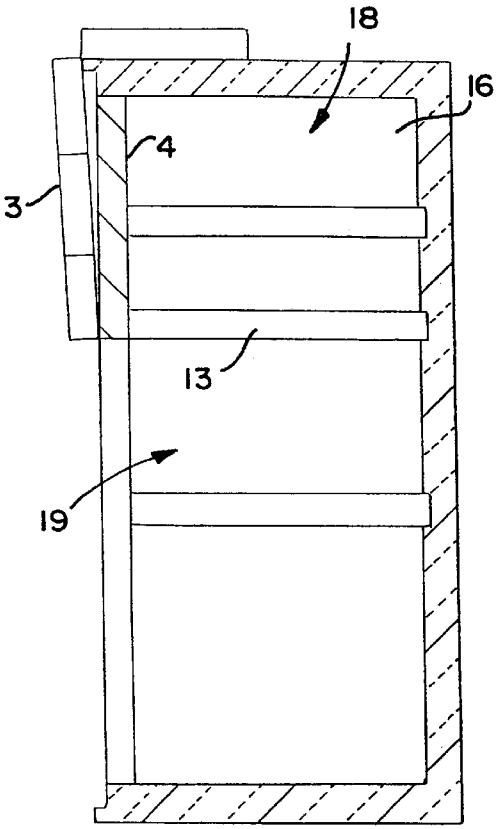
FIGS. 2*a* through 2*c* are cross-sectional view of the container with its door arrangement open in three different positions.
Figure 2B:
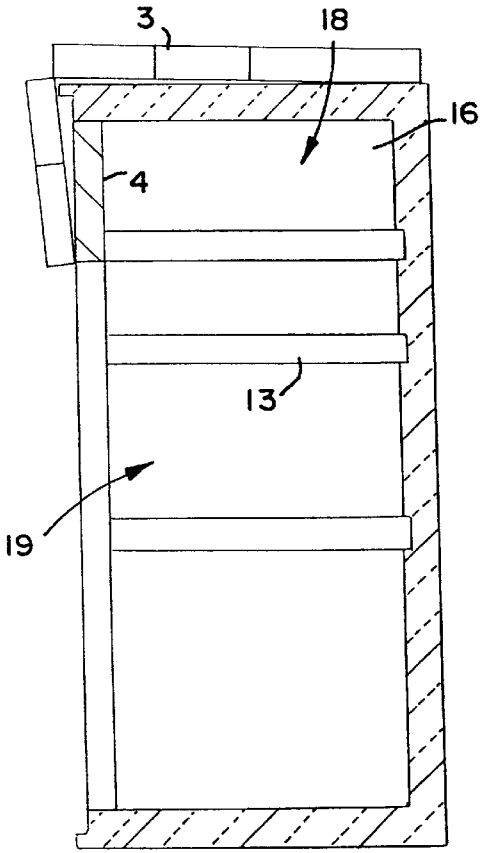
Figure 2A:
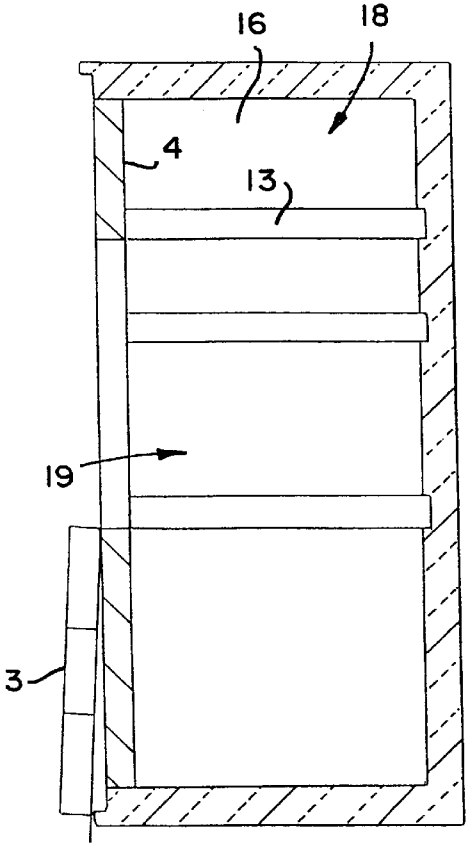

FIGS. 2*a*, 2*b* and 2*c* illustrate cross-sectional views of the container 1 with its door arrangement in three positions. In FIG. 2*a*, the lower door 3 is semi-opened, i.e. the upper part of the lower door 3 is folded downwards to give access to the upper part of the lower room 19 in which the goods are stored. The upper door 4 is in its closed position, and thus the upper room 18 is closed. In FIG. 2*b*, the lower door 3 is completely open, and rests upon the top side of the container 1. In this position, the entire lower room 19 is accessible while the upper door 4, and thus the upper room 18, are closed. In FIGS. 1 and 2, a one-day cell, such as cell 16, is provided.

In FIG. 2*c*, the upper door 4 is in its closed position, and one upper part of lower door 3 is closed, while the other part of the lower door 3 is open and rests upon the top of the container 1. In this arrangement, the panel 13 is arranged in its lowest position, and the size of the upper room 18 then allows the use of a three-day cell 17, while the upper room 18 is sealed by the upper door 4 and by a portion of the lower door 3.

With the door arrangements described above, the cell 16, 17 remains closed and protected during opening of lower door 3 for partial unloading of products, which makes this container 1 uniquely suited to very frequent lower door 3 openings situations like in the case of catering distributors.

Within the scope of the claimed invention it is possible to alter the number of insulating panels 13, 14, and the number of cells 16, 17 used in the container 1. It should be understood that the container 1 may be provided with more grooves or recesses for the support of panels and cells. Thus, one or more cells can be applied in combination with one or more insulating panels, to achieve the optimum refrigeration capacity, duration and temperature, and for the purpose of handling chilled and frozen goods at the same time in the container 1.

While a preferred embodiment of the present invention is shown and described, it is envisioned that those skilled in the art may devise various modifications of the present invention without departing from the spirit and scope of the appended claims.

The invention claimed is:

1. A container for the storage or transport of goods, such as food goods, in a frozen and/or chilled state comprising:

a housing;

a cell having a refrigerating medium therein mounted within said housing;

a first insulating panel being removably mounted within said housing to define an upper section in which said cell is mounted and a lower section in which the goods are to be mounted, said first insulating panel providing for a predetermined amount of cold transfer between said upper section and said lower section of said housing; and said first insulating panel being removable from said housing and replaceable by a second insulating panel which provides for a different predetermined amount of cold transfer between said upper section and said lower section of said container, said second insulating panel being removable from said housing.

2. A container as defined in claim 1, wherein one of said first or second insulating panels has an aperture therethrough.

3. A container as defined in claim 1, wherein one of said first or second insulating panels is solid.

4. A container as defined in claim 1, wherein more than one insulating panel is mounted in said housing at the same time.

5. A container as defined in claim 4, wherein one of said insulating panels mounted within said housing is solid and another one of said insulating panels mounted within said housing has an aperture therethrough.

6. A container as defined in claim 5, wherein said solid insulating panel and said apertured insulating panel are spaced from each other within said housing to divide said housing into a plurality of sections, each said section having a different predetermined temperature therein.

7. A container as defined in claim 1, wherein the temperature within said lower section ranges from approximately −18° C. to approximately −30° C.

8. A container as defined in claim 1, wherein the temperature within said lower section ranges from approximately 0° C. to approximately 5° C.

9. A container as defined in claim 1, wherein said refrigerant within said cell is solid carbon dioxide.

10. A container as defined in claim 1, wherein said cell includes an injection port and said refrigerant is carbon dioxide which is injected into said cell through said injection port.

11. A container as defined in claim 10, wherein said top further includes slots therethrough for venting gases.

12. A container as defined in claim 11, wherein said top includes a chamber mounted thereon which is surrounded by said body when said top is mounted on said body.

13. A container as defined in claim 1, wherein said cell has body and a top which can be removed from said body such that when said top is removed, said refrigerant is placed within said body.

14. A container as defined in claim 13, wherein said refrigerant is a slab of dry ice or pellets of solid carbon dioxide.

15. A container as defined in claim 14, wherein said top further includes slots therethrough for venting gases.

16. A container as defined in claim 1, wherein more than one cell is mounted in said housing at the same time.

17. A container as defined in claim 1, further including latch means mounted on said housing, said latch means preventing removal of said cell and said insulating panel when said latch means is engaged thereagainst.

18. A container as defined in claim 17, wherein said latch means can be moved out of contact from against said cell and said insulating panel such that said cell and said insulating panel can be removed from said housing.

* * * * *

UNITED STATES PATENT AND TRADEMARK OFFICE

CERTIFICATE OF CORRECTION

PATENT NO. : 6,131,404 
DATED : October 17, 2000
INVENTOR(S) : Gary M. Hase; Colin Trundley; Laura Lozza; Paul Shotton and Åse Spangelo.

It is certified that error appears in the above-identified patent and that said Letters Patent is hereby corrected as shown below:

Item [75] Inventors: "Gary M. Hase, Colin Trundley, Laura Lozza, Paul Shottom, Åse Spangelo"

should be -- Gary M. Hase, Colin Trundley, Laura Lozza, Paul Shotton, Åse Spangelo --

Signed and Sealed this

Second Day of October, 2001

*Attest:*

Nicholas P. Godici

NICHOLAS P. GODICI

*Attesting Officer*

*Acting Director of the United States Patent and Trademark Office*